US011823653B1

(12) United States Patent
Baxter

(10) Patent No.: US 11,823,653 B1
(45) Date of Patent: Nov. 21, 2023

(54) MOUTH-CONTROLLED ELECTRONIC MUSICAL INSTRUMENT

(71) Applicant: Keith M. Baxter, Brookfield, WI (US)

(72) Inventor: Keith M. Baxter, Brookfield, WI (US)

( * ) Notice: Subject to any disclaimer, the term of this patent is extended or adjusted under 35 U.S.C. 154(b) by 215 days.

(21) Appl. No.: 16/991,272

(22) Filed: Aug. 12, 2020

Related U.S. Application Data

(60) Provisional application No. 62/889,297, filed on Aug. 20, 2019.

(51) Int. Cl.
*G10H 5/00* (2006.01)
*G10C 3/12* (2006.01)

(52) U.S. Cl.
CPC ..... *G10H 5/005* (2013.01); *G10C 3/12* (2013.01)

(58) Field of Classification Search
CPC ..... G10H 5/005; G10C 3/12
See application file for complete search history.

(56) References Cited

U.S. PATENT DOCUMENTS 3,571,480 A * 3/1971 Tichenor ..... G10H 3/24 84/723
3,878,748 A * 4/1975 Spence ..... G10H 3/24 84/723
RE29,010 E * 10/1976 Spence ..... G10H 3/24 84/723
5,760,324 A * 6/1998 Wakuda ..... G10H 1/42 84/612

FOREIGN PATENT DOCUMENTS

DE 102018000554 A1 * 9/2018

OTHER PUBLICATIONS

Rothman, Volume Determination Using Acoustic Resonance, Johns Hopkins APL Technical Digest, vol. 12, No. 2 (Year: 1991).*

* cited by examiner

*Primary Examiner* — Jianchun Qin
(74) *Attorney, Agent, or Firm* — Boyle Fredrickson, S.C.

(57) ABSTRACT

An electronic musical instrument is tonally controlled by the configuration of a user's mouth and lips. The present invention uses a generated frequency signal to excite a first frequency signal from the user's mouth and lips. The present invention then adjusts the generated frequency signal using a phase-locked loop controller to achieve a close match to the natural frequency of the user's mouth and lips. The generated frequency signal is then played back after processing.

15 Claims, 3 Drawing Sheets

MOUTH-CONTROLLED ELECTRONIC MUSICAL INSTRUMENT

CROSS REFERENCE TO RELATED APPLICATION

This application claims the benefit of U.S. provisional application 62/889,297 filed Aug. 20, 2019, and hereby incorporated by reference.

STATEMENT REGARDING FEDERALLY SPONSORED RESEARCH OR DEVELOPMENT

--

BACKGROUND OF THE INVENTION

The present invention relates to an electronic musical instrument that is tonally controlled by the acoustic volume defined by a user's mouth and lips.

Most people use the mouth and lips to make sounds every day, including speaking as well as musical sounds like singing and whistling. This is done by expelling air from the lungs, which can create an audible vibration by exciting the vocal chords (as in singing or speaking) or by creating air turbulence in the mouth (as in whistling). Our ability to control the shape of the lips, the degree to which the jaw is held open, the lift of the soft palate within the mouth, the placement of the tongue, and numerous other muscular movements are developed early in life allowing humans to precisely control the character of the audible vibration (including its frequency and harmonic content) for speaking, singing and whistling.

Musical instruments allow us to produce sounds beyond the limits of speaking, singing, and whistling, greatly expanding our capacity to produce music in a wide variety of forms. Playing even a simple musical instrument, for example, mastering a piano keyboard or the finger positions of a guitar, often requires many years of practice, and being able extemporize with such instruments is beyond the reach of all but a few highly skilled.

SUMMARY OF THE INVENTION

The present inventor has recognized that the shape of the human mouth provides an extremely intuitive and precise control source for a musical instrument using a muscle set that is extremely familiar and practiced. Accordingly, the present invention provides a musical instrument controlled in at least one important dimension, such as frequency, by a derived acoustic volume of the user's mouth.

Specifically, in one embodiment, the invention provides a musical instrument having a speaker for receiving a first electrical signal to produce a corresponding audio output, a microphone for receiving an audio input to produce a corresponding second electrical signal, and a mouthpiece providing an acoustic coupling between a user's oral cavity and the speaker and microphone. A circuit communicates with the speaker and microphone to (a) detect an acoustic resonant frequency of the oral cavity; and (b) provide a musical output based on that acoustic resonant frequency.

It is thus a feature of at least one embodiment of the invention to provide a new musical instrument that can be intuitively controlled by mouth volume.

The instrument may include at least one finger actuable key providing an electrical switch controlling the output during activation of the speaker.

It is thus a feature of at least one embodiment of the invention to introduce precise timing control of musical notes beyond frequency or sound timbre controlled through an intuitive striking of a key.

In some embodiments the instrument may include three finger-actuable keys each providing an electrical switch controlling the output during activation of the speaker to control different frequencies of the output.

It is thus a feature of at least one embodiment of the invention to add additional dimensions of musical control, for example, harmony or spectral shading, through additional buttons.

The instrument may further include an envelope generator for providing amplitude modulation of the output according to an envelope triggered by the key.

It is thus a feature of at least one embodiment of the invention to emulate the envelope shapes of a variety of types of instruments by rapid timing control of the timing control of acoustic volume.

The musical output may provide a signal having a fundamental frequency that is mapped monotonically to the acoustic resonant frequency of the oral cavity.

It is thus a feature of at least one embodiment of the invention to provide an intuitive mapping between acoustic volume and note. In one embodiment, the fundamental frequency and acoustic resonant frequency are related by a factor of $2^N$ where N is an integer, that is they are the same note being either identical or one or more octaves apart.

It is thus a feature of at least one embodiment of the invention to provide a musical output approximating that which would be provided by an individual whistling and thus to make use of that intuitive connection to facilitate learning.

The musical instrument may include a second speaker receiving the output to provide an acoustic signal perceivable by a human.

It is thus a feature of at least one embodiment of the invention to allow the musical instrument to be fully self-contained without separate amplifiers or synthesizers for convenient use.

The musical output may provide only quantized note frequencies in a standard musical scale.

It is thus a feature of at least one embodiment of the invention to simplify the production of music by those without perfect pitch and to assist in rapid note creation.

The speaker and a microphone may have substantially parallel axes of maximum output and sensitivity respectively.

It is thus a feature of at least one embodiment of the invention to arrange the microphone and speaker to minimize cross talk allowing more sensitivity to the acoustic volume within the mouth.

The speaker and microphone maybe separated from each other and not from the oral cavity by a baffle between the speaker and microphone.

It is thus a feature of at least one embodiment of the invention to allow the speaker and microphone to be displaced outside of the mouth for convenient manufacture while minimizing cross talk.

The mouthpiece may provide a lip support ridge extending outwardly along a direction from the speaker and microphone to the oral cavity from a stop surface so that the lip may extend between a user's lips when the stop surface abuts a front of the user's lips.

It is thus a feature of at least one embodiment of the invention to promote consistent placement mouth to improve the consistency of performance of the instrument.

Front surfaces of the speaker and microphone may be recessed behind a further forward extent of the lip support ridge by less than ½ inch.

It is thus a feature of at least one embodiment of the invention to minimize the acoustic volume associated with the mouthpiece to improve a range of performance (for example, frequency range) of the musical instrument.

The speaker and microphone maybe separated by less than one quarter of an inch.

It is thus a feature of at least one embodiment of the invention to provide an extremely compact mouthpiece with good coupling to the oral cavity.

The electronic circuit may modify an amplitude of the first signal according to an amplitude of the second signal to promote a constant amplitude of the second signal during changes in the acoustic volume.

It is thus a feature of at least one embodiment of the invention to accommodate variations in attenuation of the mouth cavity at different volumes.

These particular objects and advantages may apply to only some embodiments falling within the claims and thus do not define the scope of the invention.

DETAILED DESCRIPTION OF THE PREFERRED EMBODIMENT

Figure 1:
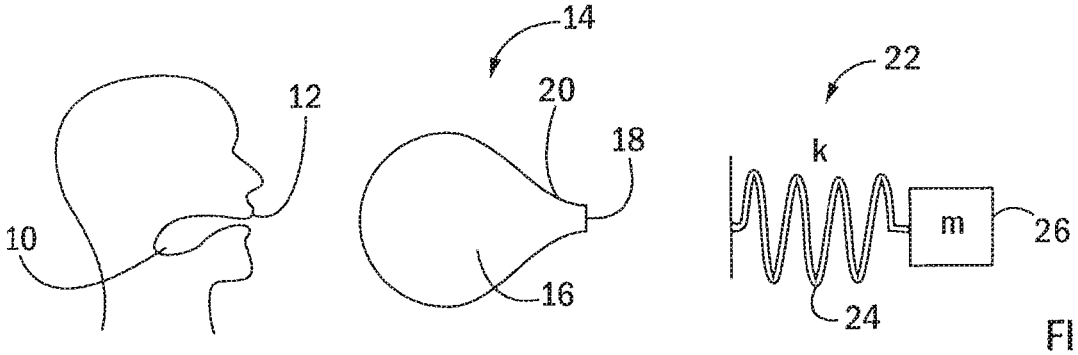
FIG. 1 is a simplified representation of three resonant systems: a human mouth and lips, a Helmholtz resonator, and a mass-spring system.

Referring now to FIG. 1, a human oral cavity 10 and lips 12 can be modeled as a Helmholtz resonator 14 to demonstrate how the mouth and lips control sound tones. A Helmholtz resonator 14 consists of a round cavity 16 with an opening 18 situated at the end of a neck 20 leading to the round cavity 16. The oral cavity 10 acts as the round cavity 16 and the lips act as an opening 18 and neck 20. The function of a Helmholtz resonator can be further modeled as a mass-spring system 22. A body of air existing within the round cavity 16 acts as the "spring" 24, as air can compress and decompress much like a spring. A plug of air existing within the neck 20 acts as the "mass" 26 as a force applied to the plug, such as air pressure changes arising from acoustic vibrations, will cause the "mass" of the plug to move into and out of the neck as it compresses and decompresses the "spring" of the cavity.

A natural frequency of a physical system is the frequency at which the system tends to vibrate after impulse excitation. For a mass-spring system, there is a single natural frequency $\omega_0$ that is a function of the mass m and the spring constant k. For the air-based system of the Helmholtz resonator, the mass m is roughly proportional to the volume of the neck 20 and opening 18, and the spring constant k is an inverse function of the volume of air in the cavity 16. Thus, in a Helmholtz resonator, the natural frequency wo can be varied by varying the size of the neck 20, opening 18, and cavity 16. In a human being, these quantities can be varied by changing the volume of the oral cavity, e.g. how the lips are shaped, moving the jaw, moving the soft palate, and so forth to create openings, necks, and cavities of different sizes and shapes. As used herein, the "oral cavity" refers to the space inside the lips and cheeks above the tongue and below the bony roof of the mouth.

Figure 2:
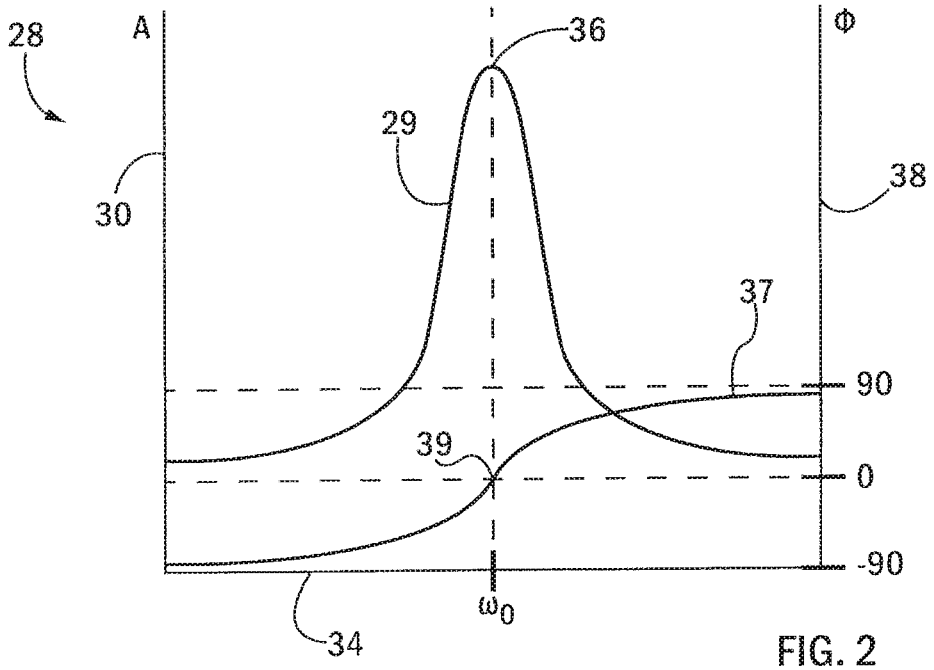
FIG. 2 is a plot of the amplitude and phase responses of the resonant systems of FIG. 1 as the frequency applied to the resonant system varies with respect to the resonant system's natural frequency wo.

Referring now to FIG. 2, resonance occurs in a system when the system is excited at a frequency that matches the natural frequency wo of the system. This results in oscillations that vibrate at a greater amplitude than when the system is excited at frequencies other than $\omega_0$. Chart 28 shows the approximate frequency response for a Helmholtz resonator. In chart 28, amplitude response curve 29 shows how the amplitude of the system's oscillation (vertical axis 30) changes as the frequency of the applied excitation frequency (horizontal axis 34) varies. A maximum amplitude 36 occurs when the frequency of excitation equals the natural frequency $\omega_0$. Phase response curve 37 shows how the phase of the system's oscillation (vertical axis 38) changes as the frequency of excitation (horizontal axis 34) varies. Far away from the natural frequency $\omega_0$, the phase of the system's oscillation asymptotically approaches 90° or −90° degrees. As the applied frequency approaches $\omega_0$, the phase of the system's oscillation approaches zero and reaches a zero point 39 at $\omega_0$.

Figure 3:
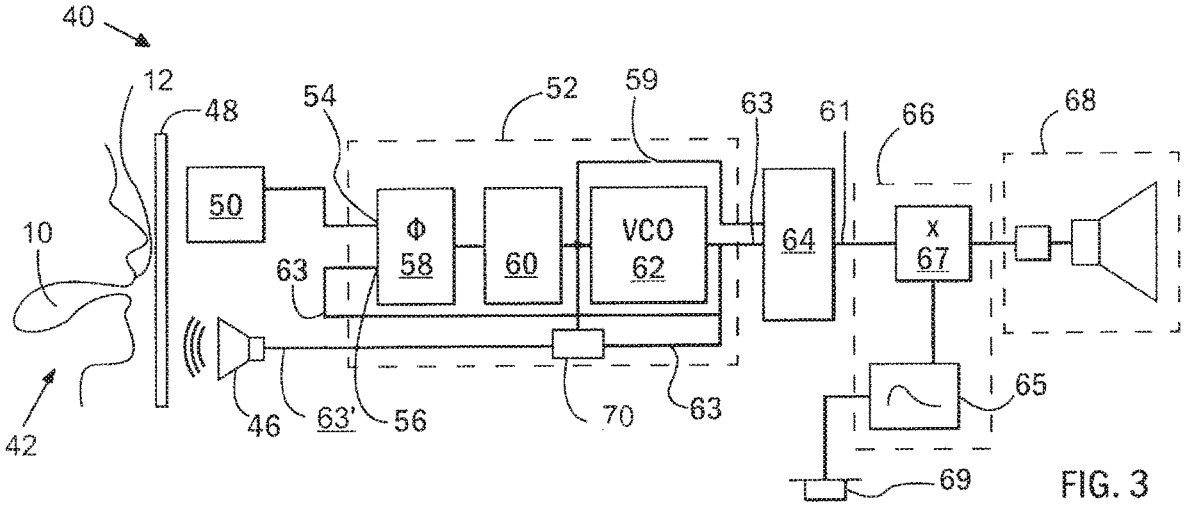
FIG. 3 is block diagram showing the receipt, generation, processing, and output of audio frequency signals within one embodiment of the system of the present invention.

Referring now to FIG. 3, the system 40 of the present invention uses a mouth of a human user 42 as a Helmholtz resonator. The Helmholtz resonator created by the oral cavity 10 and lips 12 has a natural frequency $\omega_0$, which can be varied by the user 42 intuitively as described in FIG. 1. A speaker 46 is held up to the lips 12, separated from the oral cavity 10 by mouthpiece 48 which in its simplest form may be a filter or diaphragm. The speaker 46 may be a piezoelectric speaker or a speaker using a magnet and coil. The speaker is driven by a speaker signal 63' from the output of an automatic gain control circuit 70 in a controller 52, which will be described below, and produces a corresponding acoustic pressure wave in the air coupled to the oral cavity 10.

A microphone 50 is simultaneously held up to the oral cavity 10 and lips 44, also separated by the mouthpiece 48 or physical filter. The microphone 50 receives an acoustic pressure wave modified by the movement of air within the oral cavity 10 and lips 44, which has been excited by the audio signal from the speaker 46 and produces a corresponding electrical microphone signal 54. The amplitude and phase of this microphone signal 54 will vary depending on how close the speaker signal 63' is to $\omega_0$, this relationship being shown in FIG. 2.

The controller 52 receives both the microphone signal 54 and the VCO output 63 (prior to the automatic gain control circuit 70 to provide more constant amplitude) as a first and second input. In one embodiment, the controller 52 may implement a phase-locked loop. The microphone signal 54 and generated VCO output 63 are compared by a phase detector 58. The phase detector generates a phase-error signal that represents the phase differential between the two signals. The phase error is then filtered by a loop low pass filter or filter system such as a PID (proportional/integral/derivative) controller. A (PID) controller responds to the phase error adjusting output based on the size of the phase there (proportional), the way the phase error accumulates over time (integral), and the rate of change of the phase error (derivative). The loop filter 60 controls the dynamics of the phase locking, that is, how quickly and over what range the loop will operate to try to match the phase of the VCO output 63 and the microphone signal 54.

The output of the loop filter 60 provides a VCO input 59 that drives a voltage-controlled oscillator (VCO) 62. The VCO 62 converts the VCO input 59 from the loop filter 60 into a VCO output 63, typically a sine wave, to simplify the analysis of phase by the phase detector 58. This generated VCO output 63 is fed to the first speaker 46 through the automatic gain control circuit 70 thus closing a loop with the microphone 50. This feedback loop adjusts the VCO output 63 to achieve a desired phase difference between microphone signal 54 and VCO output 63 associated with a close match to wo. The natural resonant frequency of the oral cavity 10 and lips 12 is achieved, at which point the controller 52 has a stable "lock" on the natural frequency $\omega_0$. If the user 42 changes the configuration of the oral cavity 10 and lips 12, coo will also change (as described in FIG. 1, above), and the phase-locked loop will readjust the VCO output 63 until a lock on the new wo is achieved. Generally, there may be some phase lag or lead in the microphone 50 and/or amplified speaker 46 which may be corrected through the introduction of a phase offset (fixed or frequency dependent) added to the phase error in the phase detector 58.

A value of the frequency of the operation of the VCO 62, for example, derived from the VCO input 59, may be used to control an automatic gain control circuit 70 controlling the amplitude of the speaker signal 63' to the speaker 46 according to a lookup table in the automatic gain control circuit 70. The values of the lookup table are selected so as to provide a constant received amplitude at the microphone 50 for improved comparison by the phase comparator 58 to the extent that the amplitudes of the VCO output 63 and microphone signal 54 remain more constant.

The particular lock frequency, again as may be indicated either by the frequency of the VCO output 63 of the VCO 62 or the value of the VCO input 59 received by the VCO 62, is then provided to a note selector/synthesizer 64.

In one embodiment, a note selector/synthesizer 64 is preprogrammed with a selected set of desired frequencies, for instance, the frequencies present in the key of G major. The note selector/synthesizer 64 compares the frequency of the VCO 62 to the frequencies in the selected set, and selects the closest frequency to generate a musical note output 61. Thus, the frequency selector can automatically quantize the user-created natural frequency $\omega_0$ of the oral cavity 10 and lips 12 to the closest musical note. Generally, this quantization may employ frequencies from any standard scale including equally tempered major and minor scales, 12 tone chromatic scales, as well as reduced note scales such as pentatonic, hexatonic, heptatonic, and the like so that the frequency of the VCO 62 is mapped monotonically to the frequency of the musical note output 61. The scales with reduced numbers of notes provide faster and more certain note selection. Stability of note selection may also be aided by the introducing hysteresis in the note selection process providing individual notes with a degree of "stickiness" where they resist changing to a subsequent different note by requiring a larger frequency distance between the VCO frequency and the current note than between the VCO frequency and the next note. Importantly, by proper selection of the frequency set, just intonation or equal tempering may alternatively be provided. For certain purposes the quantization may be disabled allowing smooth glissendo between notes. In each of the equal tempered scales, intervals between notes may be a multiple of the 12th root of 2 raised to the power of N where N is an integer. The frequency basis for any scale may be, for example, with reference to standard concert tuning such as A=440 Hz but any tuning may be adopted as desired. In one embodiment, the relationship between the VCO output 63 and the musical note output 61 may be according to an interval of a unison or integer number of octaves ($2^N$ where N is an integer), to provide consonance between the sound heard by the user 42 from the speaker 46 and the note actually being produced for more intuitive playing.

Whereas the VCO output 63 may preferably be a sine wave to simplify the phase analysis by the phase detector 58, the musical note output 61 may be an arbitrary wave shape selected for aesthetic qualities including sine wave, triangle wave, sawtooth wave, pulse wave and wave table waves of arbitrary shape. In this respect the note selector/synthesizer 64 may act as a synthesizer receiving a guiding note value and synthesizing a desired note output signal according to any well-known synthesis technique including FM synthesis, procedural synthesis and the like.

In one embodiment, an envelope modulator 66 receives the output from the note selector/synthesizer 64. The envelope modulator may include an envelope generator 65, which generates an envelope of varying amplitude that approximates the varying amplitude found in a note made by a desired musical instrument or by human vocal cords, that is, by controlling the attack, delay, sustain, and release of the note as is understood in the art. A modulator 67 multiplies the generated envelope with the musical note output 61 received by the envelope modulator 66, thus creating an envelope-modulated signal.

A control button 69 can control this process, for instance, causing a sequencing through attack, delay, sustain, and release to only occur when the control button 69 is actuated. In this respect, the control button 69 provides the timing of the note in the manner that a key on a piano provides the timing of the note. This allows the user 42 to change the note described by the oral cavity 10 without changing the output node from speaker 68 permitting rapid transitions in the frequency output from the speaker 68 while providing good locking characteristics of the phase lock loop of the controller 52. Other controls may be provided to allow adjustment of the envelope or to cycle through multiple different envelope shapes.

After processing has been completed to the desired extent (if at all), a second amplifier speaker 68 receives the ultimate output signal and audibly broadcasts it. Alternatively, the VCO input 59 or VCO output 63 may be used as a control voltage or control signal for an external synthesizer, or maybe converted to a M IDI signal by appropriate circuitry or to a control voltage for standard synthesizer modules.

Figure 4:
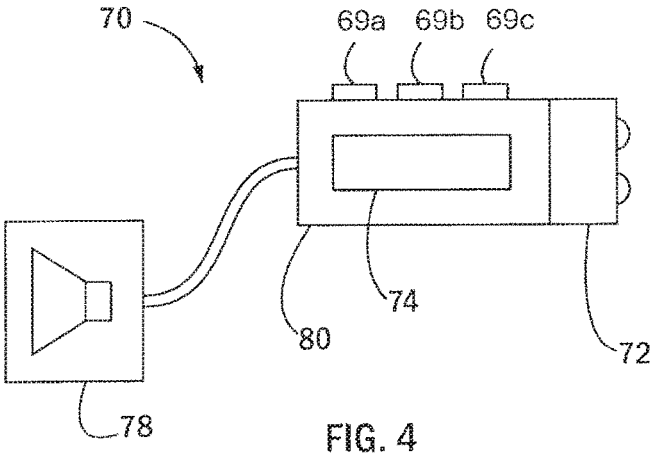
FIG. 4 is a simplified schematic of a physical embodiment of the system of the present invention.

Referring now to FIG. 4, a system 40 may include, in one embodiment, a mouthpiece 72, a processor 74, control buttons 69*a*-69*c*, and an output speaker 78. In this case, the processor 74 may execute an internal program stored in non-transitory media to implement the controller 52, the note selector/synthesizer 64 and the envelope modulator 66. The processor 74 may communicate with one or more amplifiers as necessary to boost the microphone signal 54 to a desired level and to boost the speaker signal 63'. Each of the forgoing elements may be enclosed within a handheld or portable enclosure 80 and may be provided with battery power for portable use.

When multiple control buttons 69*a*-69*c* are provided each of these may be associated with a different note selector/synthesizer 64 or a different voice of a single note selector/synthesizer 64 and different envelope generator 66 to produce separate notes, for example, related to the VCO output 63. In one embodiment one-button 69*a* may produce a note having a fundamental frequency matching the note of the VCO 62 and the other two buttons may produce notes that are proper for a chord embracing the note of button 62*a*, for example, having an interval of ⅓ and ⅕ for a major chord. Alternatively, the buttons 62*b*, 62*c* may modify the volume, tone, harmonic content, or the like of the note selector/synthesizer 64, for example, in the manner of a Wawa pedal.

Figure 7:
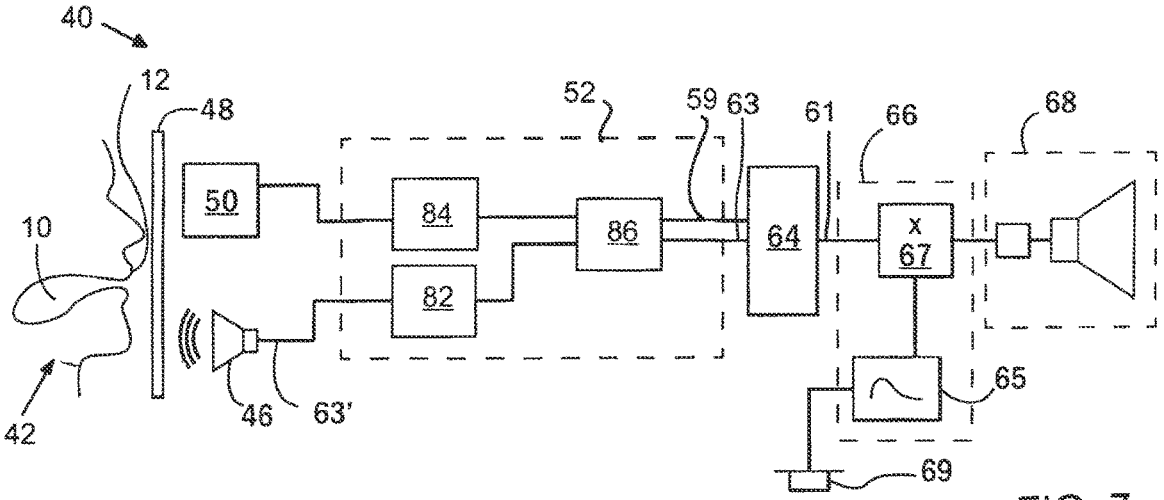
FIG. 7 is a figure similar to FIG. 3 providing a first alternative resonant frequency identifying circuit.

Referring now to FIG. 7, the invention contemplates other approaches to determining the resonant frequency of the oral cavity 10. For example, the speaker 46 may be controlled by a waveform generator 82 (for example, a digitally controlled amplifier) by a processor 86 to sweep rapidly through frequencies within a range of musical notes, and the microphone 50 may provide a signal to a waveform analyzer 84 (for example, an analog to digital converter operating in conjunction with the preprogrammed processor 86 in the controller 52) to detect the amplitude peak 36 shown with respect to FIG. 2.

Figure 8:
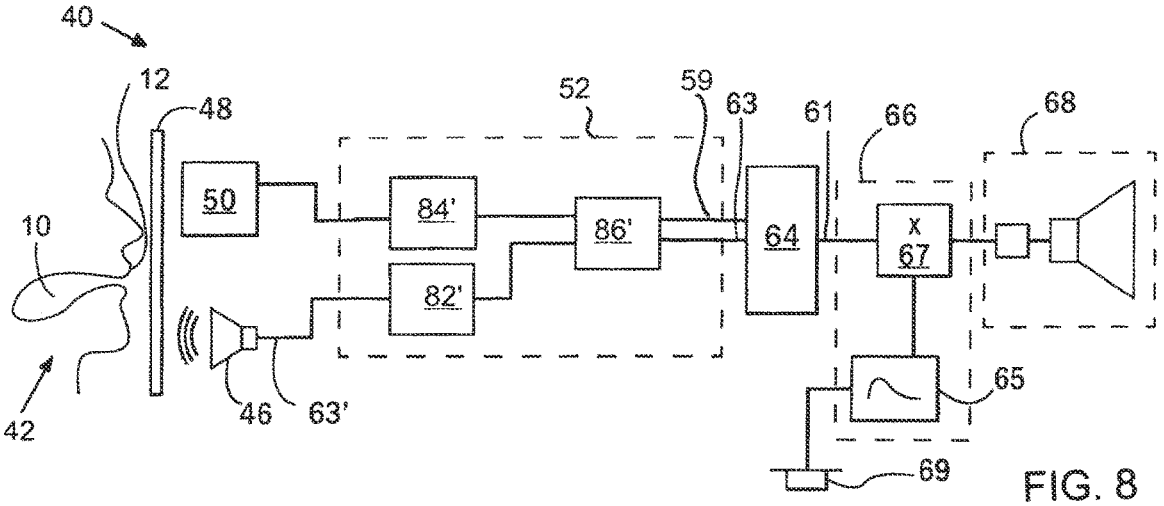
FIG. 8 is a figure similar to FIGS. 3 and 7 showing a second alternative resonant frequency identifying circuit.

Alternatively and referring to FIG. 8, the waveform generator 82' may provide a simultaneous output of frequencies within a range of musical notes (for example, as white noise, or a composite of the desired notes, and impulse or click), and the processor 86' and waveform analyzer 84' may extract a frequency with the peak amplitude or the proper phase relationship using the fast Fourier transform. Alternatively, the impulse or click may be output by the amplified waveform generator 82', and the frequency of the resulting free oscillation of the oral cavity measured, for example, using the Fourier transform or a zero crossing frequency measurement or the like performed by the processor 86' which may then output a control voltage analogous to VCO input 59 or digital signal to the note selector/synthesizer 64.

Figure 5:
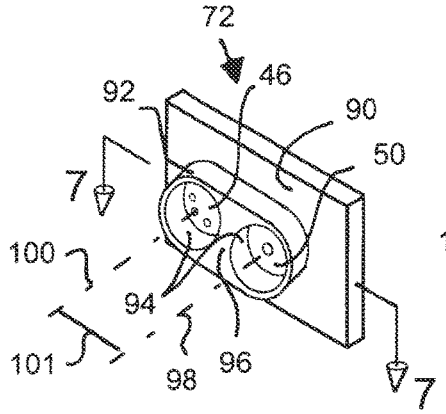
FIG. 5 is a perspective view of a mouthpiece used in the apparatus of FIG. 3 showing parallel aligned speaker and microphone positioned on a lip shield with a separating baffle.
Figure 6:
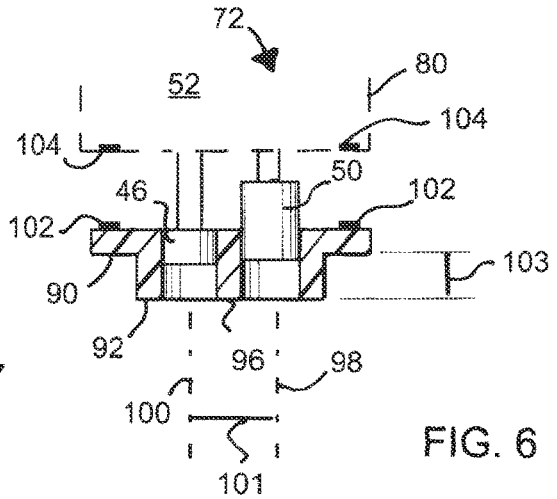
FIG. 6 is a cross-section along line 6-6 of FIG. 5 showing the alignment of the front surfaces of the microphone and speaker.

Referring now to FIGS. 5 and 6, the mouthpiece 72 may provide a lip abutment surface 90 against which the lips 12 of a user 42 may be pressed to surround a rim 92 extending out from the lip abutment surface 90 that may fit between the user's lips 12. The rim 92 may provide a pair of conduits 94 providing passage of sound from the speaker 46 into the oral cavity 10 and back to the microphone 50 unobstructed by the lips 12. One conduit 94 may hold the microphone 50 and the other conduit may hold a speaker 46 separated by a baffle plate 96 to reduce cross talk between these two elements. Generally, the axis 98 of greatest sensitivity for the microphone 50 and the axis of strongest acoustic power 100 for the speaker 46 will be parallel to each other also to reduce cross talk and to improve coupling with the oral cavity 10. Ideally the speaker 46 and microphone 50 will be compact in size (e.g., less than 15 mm in diameter) so as to be separated by less than one quarter of an inch at their closest surfaces and/or have their axes 98 and 100 separated by a distance 101 of less than 1 inch to couple sound freely with the oral cavity 10 of an average human mouth. In addition, a distance of recess 103 of front surfaces of the speaker 46 and microphone 50 behind a frontmost extent of the rim 92 may be less than half an inch and preferably less than ⅜ of an inch to minimize the acoustic volume within the rim 92 such as may reduce the instrument sensitivity to change in the acoustic volume within the mouth cavity.

The mouthpiece 72 may be constructed of multiple parts so that the rim 92 and plate of the lip abutment surface 90 may be separated from the speakers 46 and microphone 50 to be replaced or washed or the like as desired, for example, and releasably held by using releasable attachment elements such as magnets 102 interacting with corresponding magnets 104 on the case 80.

The term "musical output" as described herein is an acoustic output or electrical signal (such as MIDI) intended to control an acoustic output suitable for playing music. Generally, this acoustic output will have a fundamental frequency from 60 to 3000 Hz.

Certain terminology is used herein for purposes of reference only, and thus is not intended to be limiting. For example, terms such as "upper", "lower", "above", and "below" refer to directions in the drawings to which reference is made. Terms such as "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features of the present disclosure and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

References to "a microprocessor" and "a processor" or "the microprocessor" and "the processor," can be understood to include one or more microprocessors that can communicate in a stand-alone and/or a distributed environment(s), and can thus be configured to communicate via wired or wireless communications with other processors, where such one or more processor can be configured to operate on one or more processor-controlled devices that can be similar or different devices. Furthermore, references to memory, unless otherwise specified, can include one or more processor-readable and accessible memory elements and/or components that can be internal to the processor-controlled device, external to the processor-controlled device, and can be accessed via a wired or wireless network.

It is specifically intended that the present invention not be limited to the embodiments and illustrations contained herein and the claims should be understood to include modified forms of those embodiments including portions of the embodiments and combinations of elements of different embodiments as come within the scope of the following claims. All of the publications described herein, including patents and non-patent publications, are hereby incorporated herein by reference in their entireties To aid the Patent Office and any readers of any patent issued on this application in interpreting the claims appended hereto, applicants wish to note that they do not intend any of the appended claims or claim elements to invoke 35 U.S.C. 112(f) unless the words "means for" or "step for" are explicitly used in the particular claim.

What I claim is:

1. A musical instrument comprising:

a speaker for receiving a first electrical signal to produce a corresponding audio output;

a microphone for receiving an audio input to produce a corresponding second electrical signal;

a mouthpiece adapted to provide an acoustic coupling between a user's oral cavity and the speaker and microphone; and an electronic circuit communicating with the speaker and microphone to:

(a) measure an acoustic resonant frequency of the oral cavity to produce a frequency signal having a constant value for a given acoustic resonant frequency; and (b) provide a musical output based on the frequency signal;

wherein the musical output is provided by an oscillator structurally independent of the speaker and microphone.

2. The instrument of claim 1 further including at least one finger actuable key providing an electrical switch operating to turn the musical output on and off during continuous activation of the speaker; and wherein the musical output provides a musical note and control by the key defines a timing of the musical note.

3. The instrument of claim 2 further including at least three finger actuable keys each providing an electrical switch controlling the musical output during activation of the speaker, at least one of the three finger actuable keys controlling different frequencies of the musical output to create a harmony.

4. The instrument of claim 1 further including an envelope generator for providing amplitude modulation of the musical output according to an envelope triggered by the key.

5. The instrument of claim 1 wherein the musical output provides a signal having a fundamental frequency that is different from the acoustic resonant frequency of the oral cavity and mapped monotonically to the acoustic resonant frequency of the oral cavity.

6. The instrument of claim 5 wherein fundamental frequency and acoustic resonant frequency are separated by a factor of 2.

7. The instrument of claim 1 wherein the musical output is quantized to discrete separated values of note frequencies in a standard musical scale.

8. The instrument of claim 1 wherein the speaker and a microphone have substantially parallel axes of maximum musical output and sensitivity, respectively.

9. The instrument of claim 1 wherein the mouthpiece provides a lip support ridge extending outwardly along a direction from the speaker and microphone to the oral cavity from a stop surface so that the lips extend between a user's lips when the stop surface abuts a front of the user's lips and provides separate channels for the speaker and microphone from the speaker and microphone to a point between the user's lips when the user's lips are against the stop surface.

10. The instrument of claim 9 wherein front surfaces of the speaker and microphone are recessed behind a furthest forward extent of the lip support ridge by less than ½ inch.

11. The instrument of claim 1 wherein the electronic circuit is selected from the group consisting of:

(a) a phase locked loop tracking a phase difference between the second electrical signal and the first electrical signal to determine the acoustic resonant frequency of an oral cavity;

(b) a spectrum analyzer monitoring a broad-spectrum signal produced by the speaker to identify variations in amplitude indicating an acoustic resonant frequency of the oral cavity; and (c) a perturbation analysis circuit sweeping a frequency of the first signal to monitor related changes in amplitude of the second signal indicating an acoustic resonant frequency.

12. The instrument of claim 1 wherein the electronic circuit includes an automatic gain control changing the amplitude of the first electrical signal according to the acoustic resonant frequency.

13. The instrument of claim 1 wherein the speaker and microphone are separated by less than one quarter of an inch.

14. The instrument of claim 1 wherein the mouthpiece is releasably attached to the musical instrument.

15. A musical instrument comprising:

a speaker for receiving a first electrical signal to produce a corresponding audio output;

a microphone for receiving an audio input to produce a corresponding second electrical signal;

a mouthpiece adapted to provide an acoustic coupling between a user's oral cavity and the speaker and microphone; and an electronic circuit communicating with the speaker and microphone to:

(a) measure an acoustic resonant frequency of the oral cavity to produce a frequency signal having a constant value for a given acoustic resonant frequency; and (b) provide a musical output based on the frequency signal wherein the musical output is quantized to discrete separated values of note frequencies in a standard musical scale;

wherein the quantization is such that a change in frequency of the musical output from a current frequency to a next frequency requires a larger difference between the next frequency and the acoustic resonant frequency of the oral cavity than between the current frequency and the acoustic resonant frequency of the oral cavity.

* * * * *